US005440910A

United States Patent [19]

Florian

[11] Patent Number: 5,440,910

[45] Date of Patent: Aug. 15, 1995

[54] KEY ADAPTOR

[76] Inventor: David W. Florian, 35 Copper Ridge, Southington, Conn. 06489

[21] Appl. No.: 261,744

[22] Filed: Jun. 17, 1994

Related U.S. Application Data

[63] Continuation of Ser. No. 71,951, Jun. 7, 1993, abandoned.

[51] Int. Cl.[6] ..... A47G 29/10

[52] U.S. Cl. ..... 70/456 R; 70/408; 70/458; D3/212

[58] Field of Search ..... 70/456 R, 458, 459, 70/460, 408, 395, 396, 397, 398; D3/207, 208, 212; 206/37.1, 37.2, 37.3, 37.5, 37.8, 38

[56] References Cited

U.S. PATENT DOCUMENTS

| | | | |
|---|---|---|---|
| D. 216,607 | 2/1970 | Samuel | D3/212 |
| 697,344 | 4/1902 | Leland | 411/339 |
| 722,061 | 3/1903 | Waldo, Jr. | 411/339 |
| 1,530,688 | 3/1925 | Murray | 70/458 |
| 1,658,431 | 2/1928 | Dodson | D3/212 |
| 1,743,563 | 1/1930 | Montuori | 70/408 |
| 1,793,594 | 2/1931 | Dodson | D3/212 |
| 1,795,291 | 3/1931 | Dunn | 70/458 |
| 1,854,081 | 4/1932 | Tucker | 70/458 |
| 1,939,023 | 12/1933 | Pritchard | 70/458 |
| 2,245,381 | 6/1941 | Biggs | 70/456 R |
| 2,699,667 | 1/1955 | Mark et al. | D3/212 X |
| 2,901,800 | 9/1959 | Koehl | 411/338 |
| 3,362,200 | 1/1968 | Lanier | 70/456 R |
| 3,421,349 | 1/1969 | St. Clair, Jr. | 70/456 R |
| 3,464,244 | 9/1969 | Hinkle et al. | D3/212 |
| 3,526,112 | 9/1970 | Herrington | 70/408 |
| 3,572,186 | 3/1971 | Dillard . | |
| 3,587,260 | 6/1971 | Tajiri . | |
| 3,786,659 | 1/1974 | Elder et al. . | |
| 3,877,269 | 4/1975 | Dehart | 70/456 R |
| 4,102,166 | 7/1978 | Hughes . | |
| 4,504,087 | 3/1985 | Pennington . | |
| 4,583,383 | 4/1986 | Bosco et al. . | |
| 4,637,238 | 1/1987 | Uda et al. | 70/408 |
| 4,910,983 | 3/1990 | Taylor | 70/456 R |
| 5,058,465 | 10/1991 | Womack | 70/456 R |
| 5,207,082 | 5/1993 | Lemaitre | 70/456 R |
| 5,232,528 | 8/1993 | Rezickenko et al. | 70/460 |

FOREIGN PATENT DOCUMENTS

| | | | |
|---|---|---|---|
| 244525 | 1/1966 | Austria | 70/456 R |
| 1101972 | 10/1955 | France | 70/456 R |
| 306633 | 10/1968 | Sweden | 70/456 R |

*Primary Examiner*—Peter M. Cuomo
*Assistant Examiner*—Darnell M. Boucher
*Attorney, Agent, or Firm*—Bachman & LaPointe

[57] ABSTRACT

A key adaptor includes a substantially rigid body member having structure for pivotable connection to a bow portion of a key so that the key is pivotable between a closed position, wherein the key is substantially aligned with the body member, and an open position wherein the key is pivoted to an angle with the body member so that the body serves as a handle for turning the key when the key is inserted into a lock. The structure for pivotable connection to the key provides a firm positioning of the key relative to the body member in a desired position.

18 Claims, 3 Drawing Sheets

KEY ADAPTOR

This is a continuation of application Ser. No. 08/071,951 filed on Jun. 7, 1993 now abandoned.

BACKGROUND OF THE INVENTION

The invention relates to the field of keys for operating locks and the like and, more particularly, to an adaptor for facilitating operation of the key in the lock.

Typical key operated looks are operated by inserting the key into the lock and turning the key to lock/unlock as desired. Turning the key can be a frustrating and annoying experience under the best of conditions, but may approach impossible for individuals who have lost or partially lost motor skill or manual dexterity such as the use of a hand, etc.

Furthermore, legislation such as the Americans with Disabilities Act (ADA), signed into law on Jul. 26, 1990, require certain doors and locks and the like to be operable by persons with disabilities.

It is the principal object of the present invention to provide an apparatus for adapting a key to facilitate operation of the key in a lock, particularly for persons who, due to disabilities or the like, have difficulty in operating such a key.

It is a further object of the invention to provide an adaptor which can be easily attached to a key so as to bring the lock which the key is to operate into compliance with acts such as the ADA.

It is a still further object of the invention to provide such an adaptor which is readily usable with a minimum amount of manual dexterity and strength.

It is another object of the invention to provide such an apparatus which facilitates proper orientation and use of the key for those who are visually impaired.

It is still another object of the invention to provide such an adaptor which is simple and durable in manufacture and use.

Other objects and advantages will appear hereinbelow.

SUMMARY OF THE INVENTION

The foregoing objects and advantages are readily attained by the present invention. According to the invention, an adaptor is provided which is attached to the bow or head portion of a key, typically via the hole traditionally provided in this portion of the key. The adaptor is pivotally attached to the key so that, when the key is to be used, it is pivoted out of or away from the adaptor to an angled position so that turning the key can be readily accomplished with the lever-like adaptor.

According to the invention, the key adaptor comprises a body member having means for pivotable connection to a bow portion of a key so that the key is pivotable between a closed position, wherein the key is substantially aligned with the body member, and an open position wherein the key is pivoted to an angle with the body member so that the body serves as a handle for turning the key when the key is inserted into a lock.

The adaptor is preferably sized so that the end of the key will extend from the adaptor when the key is in the closed position. In this manner, advantageously, the key can be easily pivoted between the closed position and open position with a minimal amount of manual dexterity or strength by dragging the edge of the key across any convenient surface or object so as to pivot the key relative to the adaptor. The adaptor is preferably connected to the key so as to provide a drag or slight resistance to pivot so that the key will remain in a desired position when pivoted.

The adaptor may preferably include numerous other useful features. For example, the pivotable connection mechanism used in the preferred embodiment to hold the key may preferably have a hole or passage disposed therethrough so that the key and adaptor combination can be attached to a key chain or other item with a chain such as, for example, a whistle. The key adaptor may also be provided with other useful features such as an edge suitable for use as a lifter for tabs of cans such as beverage cans which, likewise, facilitates the opening of such cans, particularly for an individual with limited manual dexterity or strength.

BRIEF DESCRIPTION OF THE DRAWINGS

A detailed description of the preferred embodiments follows, with reference to the accompanying drawings, wherein.

DETAILED DESCRIPTION

The invention relates to a key adaptor for facilitating the operation of a key to lock/unlock a lock, and is particularly useful for individuals having impaired physical strength or manual dexterity or the like.

Figure 1:
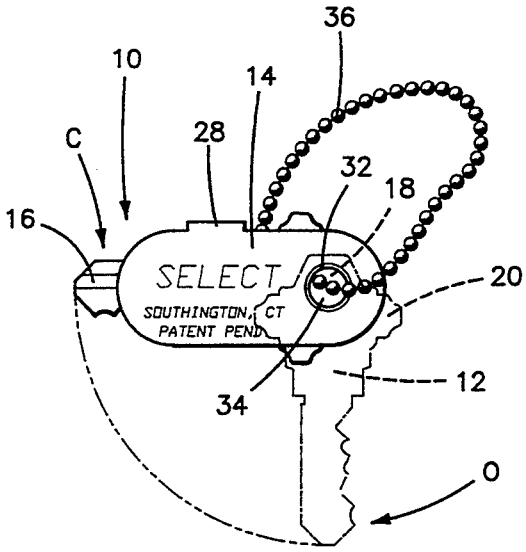
FIG. 1 is a side view of a key adaptor according to the invention, pivotally mounted to a key.

FIG. 1 illustrates a key adaptor 10 according to the invention, pivotably attached to a key 12. As shown, pivotable attachment of adaptor 10 to key 12 allows key 12 to be pivoted between a closed position, generally indicated by reference letter C, and an open position, generally indicated by reference letter O.

Adaptor 10 preferably comprises a body member 14 which may preferably have an at least marginally elongate shape so that, when body 14 is pivoted to an angle with key 12, body 14 serves as a substantially rigid and firmly positioned lever-like handle for the key, thereby facilitating insertion of key 12 into a lock, and greatly facilitating the turning of key 12 in the lock. The provision of such a firmly positioned substantially rigid handle member for the key allows the key to be turned to operate the lock without a twisting of the wrist, which greatly facilitates the use of the key for a person who has lost such ability. In this regard, the invention specifically addresses one of the concerns of the aforementioned ADA.

Body 14 is preferably provided having a length, a first end terminating at a first edge and a second end spaced lengthwise from the first end and terminating at a terminal edge opposite the first edge. The body is sufficient to overlap most but not all of key 12 when key 12 is in the closed position C. In this way, an end portion 16 of key 12 will extend beyond the terminal end of body 14. Pivot of key 12 relative to body 14 is thereby greatly facilitated as key 12 can be pivoted by dragging key 12 across any convenient structure or surface.

Key 12 is preferably attached to body 14 through a member for pivotably connecting key 12 and body 14, preferably with a certain amount of drag or resistance to pivot, so that key 12 will be firmly held in place at the desired position to which it is pivoted, and will not be relocated by forces such as gravity, incidental contact of the key with other lock elements in the vicinity, or the like. The connection member may suitably be a rivet or pin, or one or more indentations disposed on body 14 so as to grasp or otherwise hold key 12. Various specific examples of embodiments of this structure are discussed in detail below. Pivotable connection may be accomplished preferably through or at the hole 18 typically located in the bow portion 20 of key 12.

The desired drag or resistance to pivot can be provided through numerous configurations of the connection member, examples of which are discussed hereinbelow.

Figure 2:
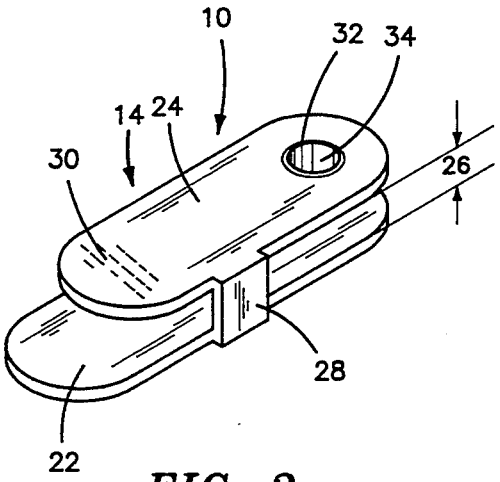
FIG. 2 is a perspective view of a key adaptor according to the invention.

Body 14 is further illustrated in FIG. 2. According to the invention, body 14 preferably includes two substantially parallel plates 22, 24, attached to each other and defining a gap 26 for receiving key 12. Gap 26 may preferably be defined in sufficient size so that plates 22, 24 contact key 12 and provide the desired drag or resistance to pivot as set forth above.

According to a preferred embodiment of the invention, adaptor 10 is provided with additional features for aiding the visually impaired as well. Various asymmetric features may preferably be incorporated into the structure of body 14 so as to facilitate proper orientation of body 14 and key 12 by feel. FIG. 2 shows body 14 with an asymmetric projection 28 which is useful for this purpose. Plates 22, 24 may also suitably be staggered, as shown. Indicia 30 may also be provided on plates 22, 24 so as to further assist the visually impaired in properly orienting key 12.

Figure 3:
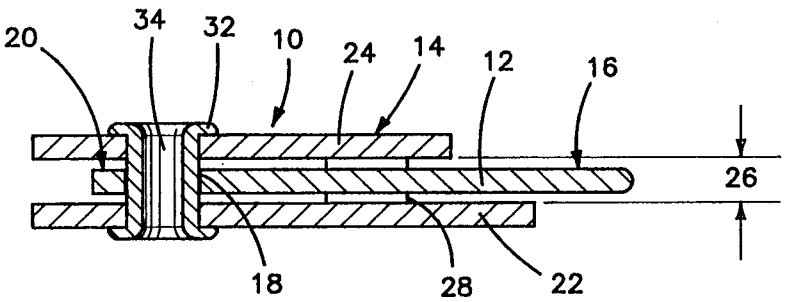
FIG. 3 is a cross-section of the key adaptor of FIG. 2.

FIG. 3 illustrates body 14 in section so as to better illustrate the structure thereof. FIG. 3 also shows an embodiment of the pivotable connection mechanism for providing pivotable connection between key 12 and body 14. This structure may include a pin or rivet 32, preferably a hollow rivet 32 as shown. Hollow rivet 32 holds key 12 at the bow portion of the key and is preferably disposed through holes in plates 22, 24 so that an opening 34 of rivet 32 passes completely through body 14 to allow adaptor 10 to be attached to a key ring or chain 36 (FIG. 1) which may, of course, hold other useful items such as additional keys/adapters, whistles, decorative items and the like.

Figure 4:
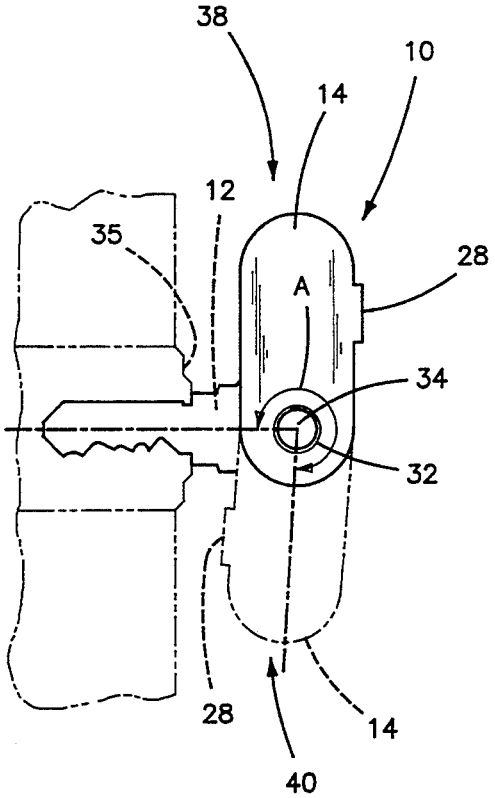
FIG. 4 is a side view of an alternate embodiment of the invention.
Figure 5:
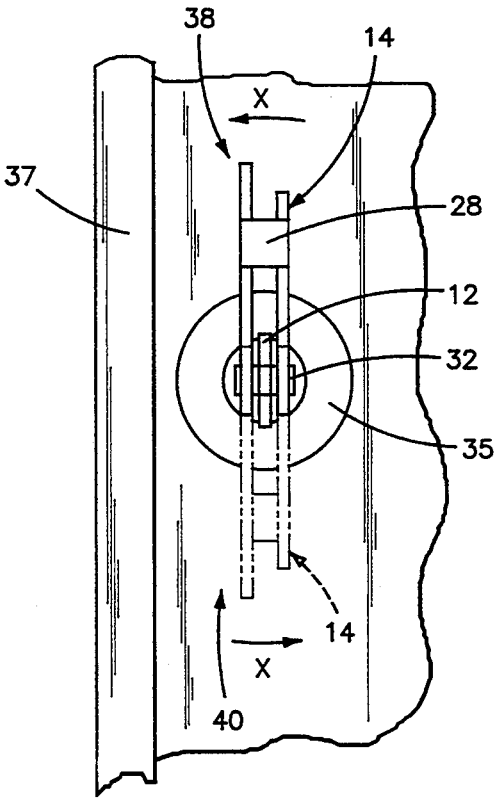
FIG. 5 is a partially broken away view of the alternate embodiment of FIG. 4.

According to another preferred embodiment, body 14 is pivotably mounted to key 12 so as to provide a degree of pivot of body 14 relative to key 12 of at least about 300°, as shown in FIG. 4 by angle A. This is useful, for example, when the lock 35 to be operated is mounted in close proximity to a door or frame 37, as exemplified in FIG. 5, so that lever-like body 14 cannot be completely rotated towards the frame. In this situation, body 14 can be further pivoted relative to key 12 from a position 38 where, during rotation in lock 35 in direction X it is interfered with by frame 37, to a position 40 where rotation of key 12 in direction X is not interfered with by frame 37, thereby further facilitating operation of key 12 in lock 35.

Figure 6B:
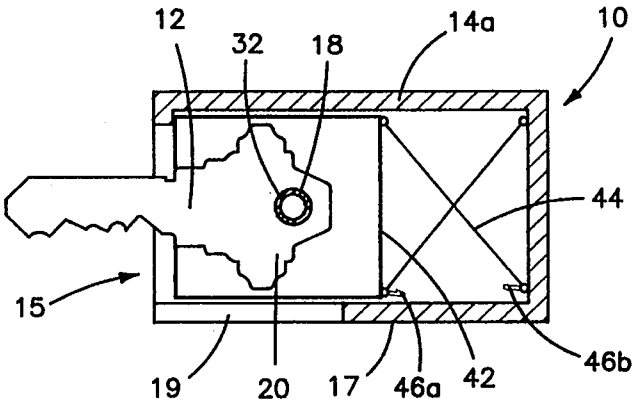
FIGS. 6*a, b* and *c* illustrate a further alternate embodiment of the invention.
Figure 6C:
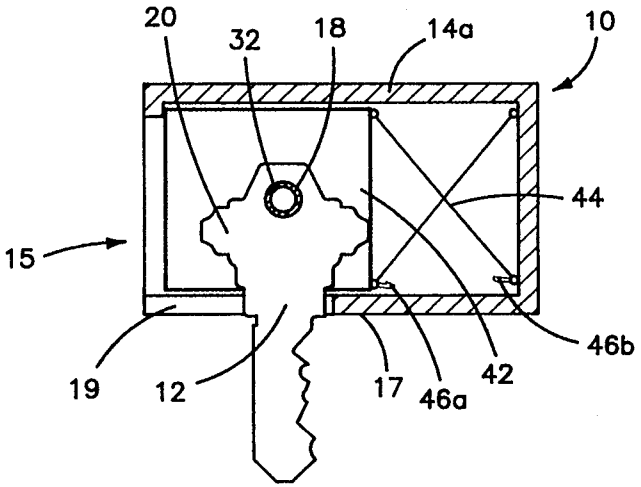
Figure 6A:
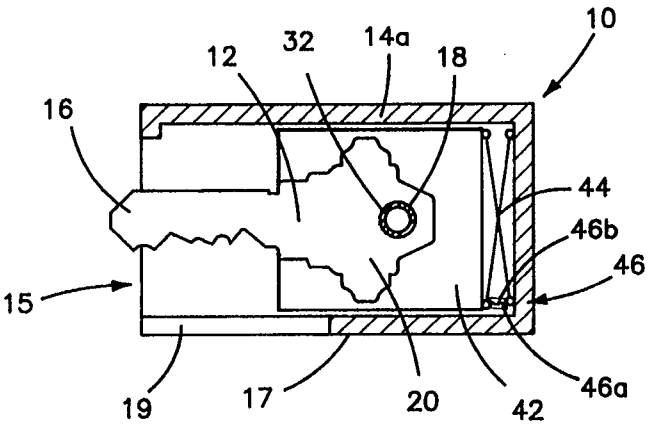

According to still another preferred embodiment, illustrated in FIGS. 6*a*, *b* and *c*, key 12 is pivotably mounted to a sliding carrier 42 disposed within body 14*a*. Key 12 is shown pivotably mounted to carrier 42 by a rivet 32 disposed through hole 18 as in the previous embodiment. Of course, the other embodiments disclosed herein are likewise suitable for attaching or engaging key 12 with carrier 42. Particularly, the embodiments of FIGS. 7*a–d* to be discussed hereinbelow could suitably be used with carrier 42. Such connection mechanisms, as described above, preferably provide a pivotable connection between key 12 and carrier 42 with a certain amount of drag or resistance to pivot so that key 12 is firmly maintained or held in a desired position to which it has been pivoted. FIGS. 6*a–c* also illustrate an alternate embodiment of body member 14*a*. As shown, body member 14*a* may be a substantially enclosed structure having an open end 15 and a partially slotted wall 17. Carrier 42 is slidable in body member 14*a* between a withdrawn position, shown in FIG. 6*a*, and an extended position, shown in FIG. 6*b*. In the withdrawn position, key 12 is substantially sheathed in body 14*a* with extending portion 16 of key 12 protruding through open end 15. In the extended position, key 12 is free to be pivoted into a desired position for use as shown in FIG. 6*c*. Specifically, when carrier 42 is in the extended position, key 12 initially protrudes straight out of body member 14*a* as shown in FIG. 6*b*. Key 12 can then be pivoted on carrier 42 into the slot 19 of slotted wall 17 so as to arrange key 12 at an angle to body member 14*a* for use. This embodiment allows key 12 to be firmly maintained within body 14*a* when key 12 is in the withdrawn position and helps to avoid inadvertent opening of the key.

Carrier 42 is preferably biased, by any conventional means such as spring 44, toward the extended position. In conjunction with this feature, a latch mechanism 46 (shown schematically in FIGS. 6*a–c*) is also preferably disposed within body 14*a* and serves to releasably catch and hold carrier 42 in the withdrawn position. Latch mechanism 46 may comprise mating hook members 46*a*, 46*b*, disposed on carrier 42 and body member 14*a* respectively. One or both of hooks 46*a*, 46*b* is preferably flexibly arranged, positioned or mounted on carrier 42 or body member 14*a* so that the hooks are engageable for retaining carrier 42 in the withdrawn or closed position of FIG. 6*a*. Latch mechanism 46 is preferably operated by pushing key 12, and thus carrier 42, toward the withdrawn position. Pushing carrier 42 into the withdrawn position serves to actuate latch mechanism 46 by engaging hooks 46*a* and 46*b* so as to catch and hold carrier 42 in the withdrawn position. Further pushing when carrier 42 is already latched in the withdrawn position serves to actuate latch mechanism 46 by disengaging hooks 46*a* and 46*b* so as to release carrier 42 to be biased by spring 44 into the extended position. This operation is similar to the operation of numerous conventional switch blade or latch type devices. Of course, numerous other latch mechanisms may also be used, including but not limited to "switch blade" type mechanisms, mechanisms controlled by exterior switches, magnetic systems and the like.

Figure 7A:
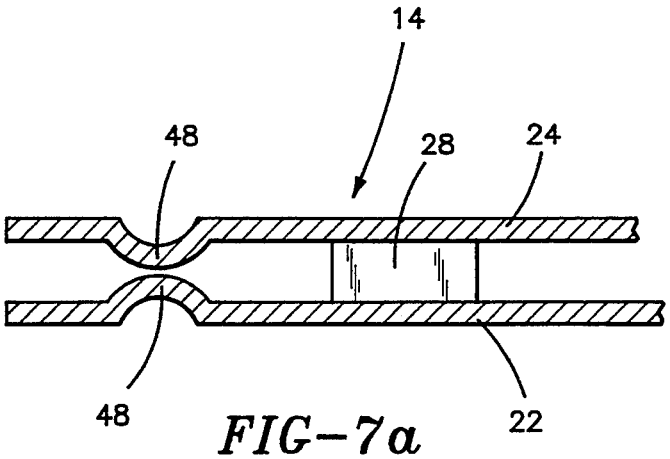
FIGS. 7*a, b, c* and *d* illustrate alternate embodiments of the pivotable connection mechanism.

According to still another preferred embodiment, adaptor 10 is readily snapped onto key 12 in any of several ways. This can be achieved by providing individual parts for plates 22, 24 which are adapted to be snapped together on either side of key 12. Alternatively, plates 22, 24 could be formed as a single part having structure to allow key 12 to be snapped into pivotable engagement between plates 22, 24. FIGS. 7*a*, *b*, *c* and *d* illustrate various examples of preferred embodiments.

FIG. 7*a* illustrates an embodiment wherein body member 14 is formed as a single or integral member wherein plates 22, 24 are joined by asymmetric projection 28. In this configuration, plates 22, 24 and asymmetric projection 28 could be formed or molded or otherwise provided as a single piece, or could be formed as separate pieces joined together through any conventional means. For additional strength, plates 22, 24 could be joined as an integral unit along an entire edge, or at several locations, as desired. Body 14 may be made of any suitable material which may preferably be selected so as to provide the desired flexibility, resilience, and/or rigidity. Plates 22, 24 preferably have inwardly disposed projections 48 which narrow gap 26 at a point to be engaged with key 12 (not shown in FIG. 7*a*), preferably by insertion into hole 18 of key 12. It should be noted, of course, that a single projection 48 would likewise be suitable. Projections 48 may preferably have an inwardly rounded shape, as shown. Such a shape serves to ensure contact between projections 48 and edges of hole 18 of key 12 which helps to provide the desired drag or resistance to pivot of key 12 relative to body 14 and, accordingly, the firm positioning of key 12 in a desired position. In use, key 12 is simply snapped into place between projections 48. The rounded shape of projections 48 also serves to accommodate use with keys of various thickness and having various sizes of hole 18.

Figure 7B:
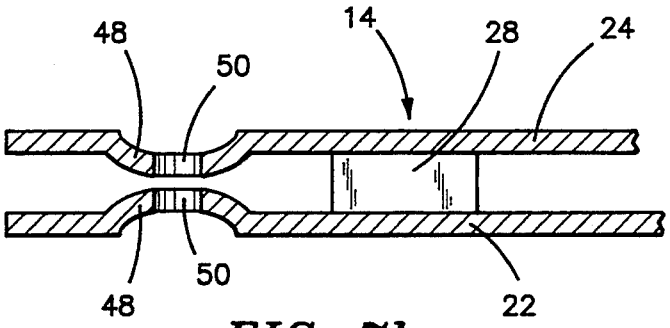

FIG. 7*b* illustrates a further preferred embodiment similar to that of FIG. 7*a* wherein projections 48 of plates 22, 24 have holes or passages 50 defined therein. Such passages 50 serve, in conjunction with hole 18 of key 12, to provide a continuous passage through which a key chain or other device can be disposed to facilitate attachment of adaptor 10 to other useful accessories such as additional keys, decorative items, whistles and the like.

Figure 7C:
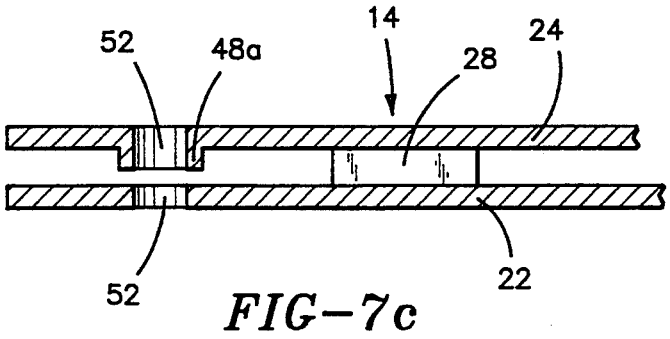

FIG. 7*c* illustrates an embodiment wherein, as mentioned above, a single projection 48*a* is disposed on one plate member 24 and wherein a passage 52 is defined through projection 48*a* and also through plate 22.

The embodiment of FIGS. 7*b* and 7*c* may, of course, be provided with plates 22, 24 formed as a single or integral piece as in FIG. 7*a* described above. Such configurations operate in the same simple manner wherein a key 12 is snapped into pivotable engagement with body 14 via projection 48*a* or projections 48.

Figure 7D:
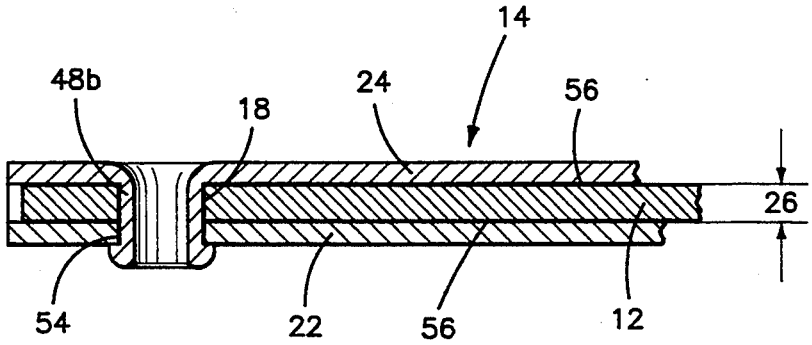

FIG. 7*d* illustrates an embodiment wherein plates 22, 24 snap together around key 12. In this embodiment, plate 24 has a projection 48*b* which may preferably have a press fit into plate 22, for example via hole 54. Projection 48*b* serves to hold key 12 as shown. Body 14 may preferably be assembled around key 12 by disposing key 12 on projection 48*b* and snapping or press fitting projection 48*b* into hole 54. The press fit of projection 48*b* into hole 54 is advantageous in that such a press fit can be used to adjust the gap 26 between plates 22, 24 and thereby provide a desired amount of drag on key 12 caused by friction between the inside surfaces 56 of plates 22, 24 and key 12, thereby providing a firm positioning of key 12 relative to body 14 in a desired position. Projection 48*b* may likewise have a passage 58 disposed therein, as shown, to provide convenient attachment of body 14 to other accessories as desired.

The foregoing embodiments, it should be noted, provide a simple and convenient way for an employer to comply with the requirements of regulations such as the ADA. By keeping a supply of adapters 10 on hand, keys can be easily adapted for any employee as desired or necessary so as to greatly facilitate use of the key. Such adaptation further avoids the expense of changing hardware in order to comply with the ADA, which expense could, of course, be significant. For such an employer, the embodiments of FIGS. 7*a, b, c* and *d* would be particularly suitable as the adaptor 10 can be mounted to the key without the assistance of a locksmith or other specialized personnel. Adaptor 10 allows disabled or partially disabled persons to operate locks with ease which locks would previously and otherwise have been difficult or impossible to operate. Particularly avoided is the need for a twisting or rotation of the wrist to rotate the key.

It should be noted that the aforementioned drag or resistance to pivot of key 12 relative to base 14 may be accomplished in numerous ways including, but not limited to, adjusting the size of gap 26 relative to the thickness of key 12, providing a pivotable connection mechanism sized to grasp key 12 at hole 18 with a desired amount of force or rigidity, combinations of the foregoing and the like.

Referring back now to FIG. 2, it should be noted that either or both of plates 22, 24 may further serve as an opener or lifter for pull tabs typically encountered in currently used cans for beverages and the like. Operation of such tabs could likewise be challenging to an individual with impaired manual dexterity or strength, and is greatly facilitated by the adaptor 10 of the present invention.

Thus disclosed is a key adaptor device which can be utilized to greatly improve the independence of individuals with disabilities that would otherwise interfere with their operation of locks and locked doors, mechanisms, and the like. Of course, the adaptor of the present invention is suitable for use with keys to any locks including, but not limited to, interior and exterior doors of the workplace or home, car doors and ignitions, safes, lockers, closets or cabinets, or any other structure, appliance or mechanism or the like which may be locked/unlocked by a key.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A key adaptor in combination with a key, comprising:

a substantially rigid body member having a length, a first end terminating at a first edge, and a second end spaced lengthwise from the first end and terminating at a terminal edge which is opposite to said first edge;

a key having a bow, a length, an end portion spaced lengthwise from the bow, and side portions extending between the bow and the end portion; and a fixed connection pivotably connecting the first end of the body member to the bow of the key so that the key is pivotable around a pivot point fixed relative to the body member between a closed position, wherein the key is aligned lengthwise within the body member and the end portion of the key is substantially adjacent to and extends lengthwise beyond the terminal edge of the second end of the body member, and an open position wherein the end portion of the key is pivoted away from the terminal edge of the second end of the body member and wherein the key is adapted to be pivoted in a pivot direction to an angle with the body member so that the body serves as one of an upwardly oriented and a downwardly oriented handle with respect to the length of the key for turning the key when the key is initially inserted into a lock, and wherein the key can be further pivoted about 180° in the pivot direction to an angle with the body member so that the body member serves as the other of the upwardly oriented and the downwardly oriented handle for turning the key, wherein said pivot point is fixed closer to said first edge of said body member than to said terminal edge of said body member, whereby the key is readily pivotable to the open position by contacting the end portion of the key with a contact surface and force required to pivot the key is minimized through application at a point spaced from the pivot point by the length of the key.

2. A key adaptor according to claim 1, wherein the fixed connection comprises a pin attached to the body member and sized to pass through a hole of the bow of the key.

3. A key adaptor according to claim 2, wherein the pin is a substantially hollow member which passes through the body member so as to provide means for connecting the key adaptor to other accessories.

4. A key adaptor according to claim 1, wherein the fixed connection further provides a drag during pivot of the key whereby the key is firmly held in a desired position relative to the body member.

5. A key adaptor according to claim 1, wherein the body member comprises two substantially parallel plates attached to each other in spaced relation so as to define a gap therebetween of sufficient size to receive the key when the key is in the closed position.

6. A key adaptor according to claim 5, wherein the fixed connection comprises at least one indentation, disposed on an inner surface of one of the two substantially parallel plates.

7. A key adaptor according to claim 6, wherein the fixed connection comprises two opposed projections disposed on inner surfaces of the two substantially parallel plates, for pivotable engagement with the bow of the key.

8. A key adaptor according to claim 7, wherein the two opposed projections are pivotably inserted into a hole formed in the bow of the key.

9. A key adaptor according to claim 8, wherein each of the two opposed projections includes a hole defined therein so as to provide means for connecting the key adaptor to other accessories.

10. A key adaptor according to claim 5, wherein the fixed connection comprises a projection formed on an inner surface of one plate and sized for a press fit into a hole defined on the other parallel plate, whereby the two parallel plates can be assembled around a key.

11. A key adaptor according to claim 10, wherein the projection has a through passage defined therein so as to provide means for connecting the key adaptor to other accessories.

12. An apparatus according to claim 5, wherein the gap is defined so that inner surfaces of the plates contact sides of the key, thereby providing a drag during pivot of the key so that the key is firmly held in a desired position relative to the body member.

13. A key adaptor according to claim 1, wherein the body member has means for identifying an orientation of the key adaptor.

14. A key adaptor according to claim 13, wherein the orientation identifying means comprises an asymmetric projection attached to the body member, whereby the key adaptor can be oriented by feel.

15. A key adapter according to claim 1, wherein the body member further includes identifying indicia stamped thereon.

16. A key adapter according to claim 1, wherein the fixed connection provides a degree of pivot of the body member relative to the key of at least about 300°.

17. A key adaptor according to claim 1, wherein the body member further includes means for lifting a pull tab of a can.

18. A key adaptor according to claim 1, wherein said key has an operative element for operating a lock, said operative element extending from said end portion and along at least one side portion of said side portions of said key, and wherein said body member overlaps at least a portion of said operative element in said closed position.

* * * * *